US008459278B2

(12) United States Patent
Jerg et al.

(10) Patent No.: US 8,459,278 B2
(45) Date of Patent: Jun. 11, 2013

(54) DISHWASHING MACHINE EQUIPPED WITH A SORPTION DRYING DEVICE

(75) Inventors: Helmut Jerg, Giengen (DE); Kai Paintner, Welden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/490,492

(22) Filed: Jun. 7, 2012

(65) Prior Publication Data

US 2012/0240965 A1 Sep. 27, 2012

Related U.S. Application Data

(63) Continuation of application No. 11/791,383, filed as application No. PCT/EP2005/055415 on Oct. 20, 2005, now abandoned.

(30) Foreign Application Priority Data

Dec. 9, 2004 (DE) ..... 10 2004 059 424
Jan. 28, 2005 (DE) ..... 10 2005 004 096

(51) Int. Cl.
*B08B 3/00* (2006.01)

(52) U.S. Cl.
USPC ..... 134/107; 134/56 D; 134/57 D; 134/58 D; 134/105

(58) Field of Classification Search
USPC ..... 134/56 D, 57 D, 58 D, 105, 107
See application file for complete search history.

(56) References Cited

U.S. PATENT DOCUMENTS

| | | | |
|---|---|---|---|
| 3,026,628 | A | 3/1962 | Berger et al. |
| 3,034,221 | A | 5/1962 | Tuck et al. |
| 4,812,621 | A | 3/1989 | Brotherton et al. |
| 2003/0079760 | A1 | 5/2003 | Spanyer et al. |
| 2006/0278257 | A1 | 12/2006 | Jerg et al. |
| 2007/0101609 | A1 | 5/2007 | Jerg et al. |

FOREIGN PATENT DOCUMENTS

| | | | |
|---|---|---|---|
| DE | 2016831 | A1 | 10/1971 |
| DE | 2252668 | A1 | 5/1974 |
| DE | 3626887 | A1 | 2/1988 |

(Continued)

OTHER PUBLICATIONS

JP 08-224201 English Translation Sep. 1996 Japan Sumida et al.*

(Continued)

*Primary Examiner* — Michael Barr
*Assistant Examiner* — Charles W Kling
(74) *Attorney, Agent, or Firm* — James E. Howard; Andre Pallapies

(57) ABSTRACT

A dishwashing machine is provided. The dishwashing machine includes a washing container, at least one device for washing crockery using a washing solution, a heating device, and a sorption drying device communicated with the washing container for the passage of air between the sorption drying device and the washing container. The sorption drying device contains reversibly dehydratable material that operates to withdraw moisture from air during the passage of the air through the sorption drying device. The sorption drying device is housed in a housing and has air passing from the washing container into the sorption drying device via an air inlet and thereafter flowing along a flow path through the sorption drying device and eventually exiting the sorption drying device via an air outlet. The heating device is located upstream of the air inlet relative to the flow of air through the sorption drying device.

22 Claims, 5 Drawing Sheets

FOREIGN PATENT DOCUMENTS

| | | | |
|---|---|---|---|
| DE | 3741652 | A1 | 6/1989 |
| DE | 4441264 | A1 | 5/1996 |
| DE | 19720837 | A1 | 11/1998 |
| DE | 19947324 | A1 | 4/2001 |
| EP | 0358279 | A1 | 3/1990 |
| EP | 1415588 | A2 | 5/2004 |
| FR | 2648484 | A1 | 12/1990 |
| JP | 51147012 | A | 12/1976 |
| JP | 01150811 | A | 6/1989 |
| JP | 4352999 | A | 12/1992 |
| JP | 8224201 | A | 9/1996 |
| JP | 08224201 | A * | 9/1996 |
| JP | 2000304448 | A | 11/2000 |
| JP | 2002340372 | A * | 11/2002 |
| SU | 1606357 | A1 | 11/1990 |
| WO | 2004056258 | A1 | 7/2004 |

OTHER PUBLICATIONS

JP 2002-340372 English Translation Nov. 2002 Japan Ishii et al.*
International Search Report PCT/EP2005/055415.
National Search Report DE 10 2005 004 096.9.

* cited by examiner a)

b)

DISHWASHING MACHINE EQUIPPED WITH A SORPTION DRYING DEVICE

CROSS-REFERENCE TO RELATED APPLICATIONS

This application is a continuation, under 35 U.S.C. §120, of U.S. application Ser. No. 11/791,383, filed May 23, 2007, which is a U.S. national stage application under 35 U.S.C. §371 of PCT/EP2005/055415, filed Oct. 20, 2005, which designated the United States; this application also claims the priority, under 35 U.S.C. §119, to German Application No. 10 2004 059 424.4, filed Dec. 9, 2004, and to German Application No. 10 2005 004 096.9, filed Jan. 28, 2005.

BACKGROUND OF THE INVENTION

The invention relates to a dishwashing machine with a washing compartment and devices for washing dishes using a washing solution as well as with a sorption drying device which is connected to the washing compartment in an air-conducting manner and which comprises a heater as well as a sorption column containing reversibly dehydratable material, the sorption column being arranged inside a housing having an air inlet and an air outlet.

According to DE 103 53 774 and/or DE 103 53 775 of the applicant, reversibly dehydratable material for desorption is heated to very high temperatures. In this case the liquid stored in the material escapes as hot water vapour. The water vapour is conducted into the washing compartment by the conduction of air through the sorption column and a pipe provided, if necessary, and the air in the washing compartment is also heated. The introduction of the hot water vapour and the heated air into the washing compartment during a partial programme step with washing solution to be heated in the processing space is not sufficient for adequate heating of the washing solution and/or the dishes. Further heating may, if necessary, be largely dispensed with and the energy used for desorption can be used almost entirely for heating the washing solution and/or the dishes, except for the energy required to overcome the binding forces between the water and reversibly dehydratable material. Besides a saving of energy, efficient cleaning of the items to be washed is therefore guaranteed.

EP 0 358 279 B1 discloses a device for drying dishes in a domestic dishwashing machine in which the washing solution is heated by a heater arranged outside the washing compartment, preferably an electric geyser, a largely closed drying system being provided in which air circulates from the washing compartment via a drying device that can be regenerated by heating and from this device back into the washing compartment. In this case the drying device consists of a drying compartment that is in thermal contact with the heater, which compartment is filled with a drying means that absorbs the moisture. Because of the connection of the drying compartment to the heater that is provided anyway for heating the washing solution, the drying device is immediately operational after completion of the washing process. The drying means is here placed at least in part as a jacket around the heating elements of the heater so that the drying means in the drying compartment can be heated and hence dried during each heating process.

The drying compartment is designed as a double-wall hollow cylinder into which the drying material is inserted. The inlet and outlet openings for connection to the closed air system are arranged diagonally opposite one another. The disadvantage of this is that there is a relatively high flow resistance, so that the fan provided for promoting the air flow must be operated at very high power. This has a negative effect in terms of noise development and energy consumption.

Because of the structural design of the sorption drying device, which requires inhomogeneous introduction of heat into the drying material, the desorption is time consuming and may also lead to local overheating of the drying means and hence to its irreversible damage. The desorption is also difficult because the heater is arranged in the centre of the double-wall hollow cylinder and radial distribution of heat to the drying means close to the outer hollow cylinder wall is hardly possible because of the air flowing axially past it.

BRIEF SUMMARY OF THE INVENTION

The object of this invention therefore consists in providing a dishwashing machine in which the drying material contained in a sorption drying device can be heated uniformly for the purpose of desorption.

This object is achieved according to the invention with a dishwashing machine according to the features illustrated, for example, in the exemplary embodiments of the invention.

In the dishwashing machine according to the invention, with a washing compartment and devices for washing dishes using washing solution, as well as with a sorption drying device which is connected to the washing compartment by circulated air in an air-conducting manner, and has a heating device as well as a sorption column with reversibly dehydratable material, the sorption column is arranged in a housing with an air inlet and an air outlet, the heating device being arranged in the direction of flow of the air in front of the air inlet, thereby introducing uniformly heated air into the sorption column.

In a preferred design the heating device is arranged in the region of the air inlet of the sorption column, i.e. in the immediate spatial vicinity of the air inlet. The advantage of this procedure lies in the fact that the air is heated at the input of the sorption column, preferably outside it, thus ensuring that hot air is supplied uniformly to it and that this hot air is conducted through the sorption column Overheating of the reversibly dehydratable material of the sorption column during desorption is in this case prevented. This applies particularly when the heating device is arranged outside the housing. Because of the immediate spatial vicinity of the heating device to the air inlet of the sorption column it is also guaranteed that the energy expended for heating the air flow can be transmitted as efficiently as possible to the reversibly dehydratable material, since cooling of the air flow due to the immediately spatial vicinity is avoided.

In a preferred design the housing has a base surface having the air inlet and a cover surface having the air outlet. This advantageously guarantees a low flow resistance inside the sorption column because the air can be conducted "straight" through the housing of the sorption column.

In a further suitable design the base surface and/or the cover surface are designed at least in certain regions as a screen, so that the air inlet and/or the air outlet is/are formed by the screen surface. In addition to fixing of the reversibly dehydratable material inside the sorption column, the flow resistance of the air flow conducted through the sorption column can be minimised thereby.

In a further suitable design the heating device and the air inlet are arranged so that they overlap each other, at least in part. The degree of overlap between the heating device and air inlet of the housing of the sorption column is in this case determined essentially by the design and the power made available by a heating device.

According to another design provision may be made for the heating device to be arranged in the immediate spatial vicinity of the air inlet of the sorption column inside the housing of the sorption column. To avoid local overheating it is in this case advantageous for the heating device to be arranged with the largest possible surface area inside the sorption column, where the specific power per unit area can be dimensioned so low that local overheating cannot take place on the reversibly dehydratable material.

In a further suitable design the housing has a housing jacket that is of thermally insulated design. This jacket may, for example, be formed by a double wall. Alternatively or in addition, thermal insulation, for example, may be applied to the outside of the housing jacket. It is also conceivable to form a vacuum in the intermediate space created between the double walls in order to main the best possible insulation to the outside. The provision of thermal insulation on the housing jacket ensures that the energy expended by heating can be utilised in the best possible manner for desorption of the reversibly dehydratable material.

In a further suitable design the height of the housing jacket is smaller than the width or diameter of the base and cover surfaces. Expressed in general terms this means that the length through which the air is to flow is smaller than the maximum width or diameter of the base and cover surfaces. This advantageously provides a low flow resistance, so that the power of the fan and speed of the fan can be designed low. A particularly preferred arrangement here is a cylindrical design of the housing of the sorption column because a particularly homogeneous air flow is guaranteed with this geometrical shape.

In a further suitable design the sorption drying device has a fan with a fan housing for generating an air flow, which housing is arranged in the immediate vicinity in front of the air inlet of the housing of the sorption column This enables the fan housing and housing of the sorption column to be designed integrally to provide a generally compact unit occupying only a small space in the dishwashing machine.

In one variant the fan may be arranged as an axial fan in front of the inlet of the housing of the sorption column. In another variant the fan is arranged as a radial fan on the side of the inlet of the sorption column housing. The variant to be chosen in preference is determined essentially by the spatial arrangement of the sorption drying device in the dishwashing machine and the spatial conditions prevailing there.

The heating device used for desorption may be designed as wire heating, as a tube-type heating element, a ceramic heating device or in positive temperature coefficient (PTC) technology.

In an advantageous design the heating device is here integrated in the fan housing, which can be achieved extremely easily, particularly when a heating device in PTC technology is used, since the resistance layer or layers can be applied to the inside of the housing wall. A further advantage of using a PTC heating device lies in its simple production, since the layers can be applied by a printing process. Furthermore, the heating power is governed by the temperatures prevailing in the heating sections themselves, so that overheating is prevented in principle. In addition, heating with a plurality of heating powers can be achieved by suitable arrangement or insertion of individual layer sections.

In a further suitable design the fan, the heating device and the housing of the sorption column may be designed as a unit to provide a generally compact sorption drying device.

In another embodiment the sorption column is used for drying the dishes on the one hand, and the thermal energy utilised for desorption of the sorption column can be used, at least in part, for heating the washing solution in the washing compartment and/or the dishes on the other. In addition to this feature, all the other features of DE 10353774 and/or DE 10353775 of the applicant can be included in further embodiments.

In a further dishwashing machine according to the invention, with a washing compartment and devices for washing dishes using a washing solution, as well as with a sorption drying device which is connected by circulated air, in an air-conducting manner, to the washing compartment and has a heating device as well as a sorption column with reversibly dehydratable material, the sorption column is arranged in a housing with an air inlet and an air outlet, the heating device being arranged on the inside or on the housing of a fan.

BRIEF DESCRIPTION OF THE DRAWINGS

The invention is explained in further detail in the following by way of a plurality of exemplary embodiments, where.

DETAILED DESCRIPTION OF EXEMPLARY EMBODIMENTS OF THE PRESENT INVENTION

Figure 7:
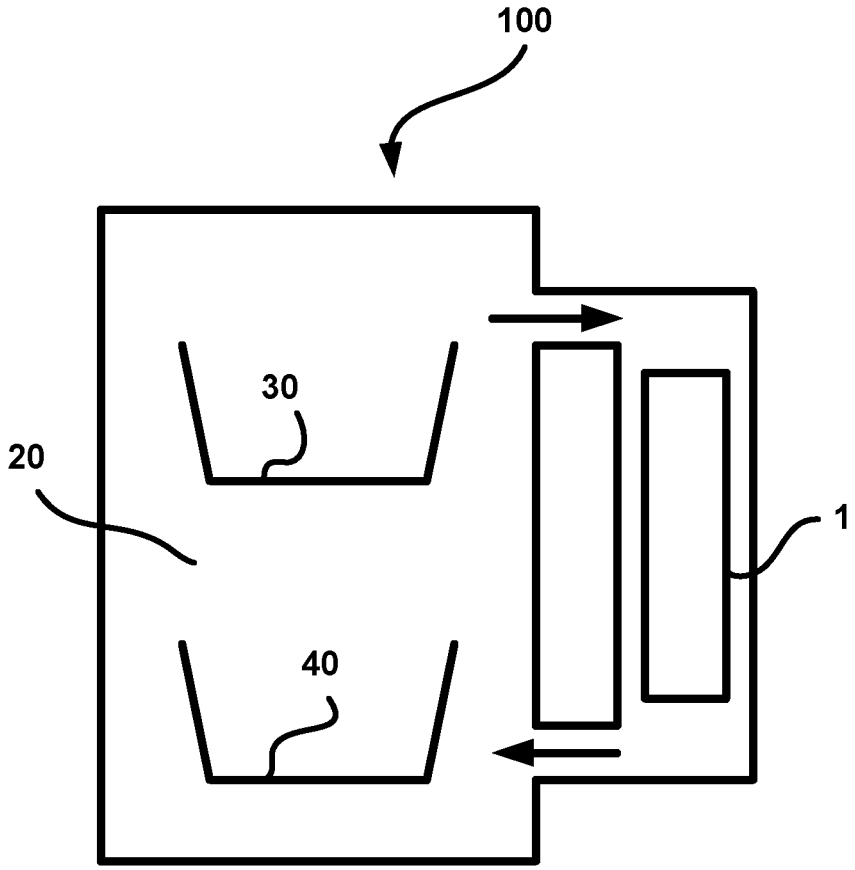
FIG. 7 shows an exemplary embodiment of a dishwashing machine according to the invention.

A dishwashing machine 100 according to the invention, as shown in FIG. 7, normally has a washing compartment 20 in which crockery baskets 30, 40 are arranged for the insertion of items to be washed. In all exemplary embodiments of the dishwashing machine 100 according to the invention the dishes are preferably dried as described in DE 10353774 and/or DE 1035375 of the applicant. The content of applications DE 10353774 and/or DE 1035375 is there also incorporated in this application, if appropriate. Furthermore, provision is made for a sorption drying device 1 connected in an air-conducting manner to the washing compartment 20, which device is connected to the washing compartment 20 in an air-conducting manner and has a heating device 6, a fan 2 and a sorption column 3 with reversibly dehydratable material, e.g. zeolith. As already explained, the sorption column is used both for drying and for heating air conducted through it.

Various exemplary embodiments of such sorption drying devices are shown in the figures explained in further detail in the following.

Figure 1:
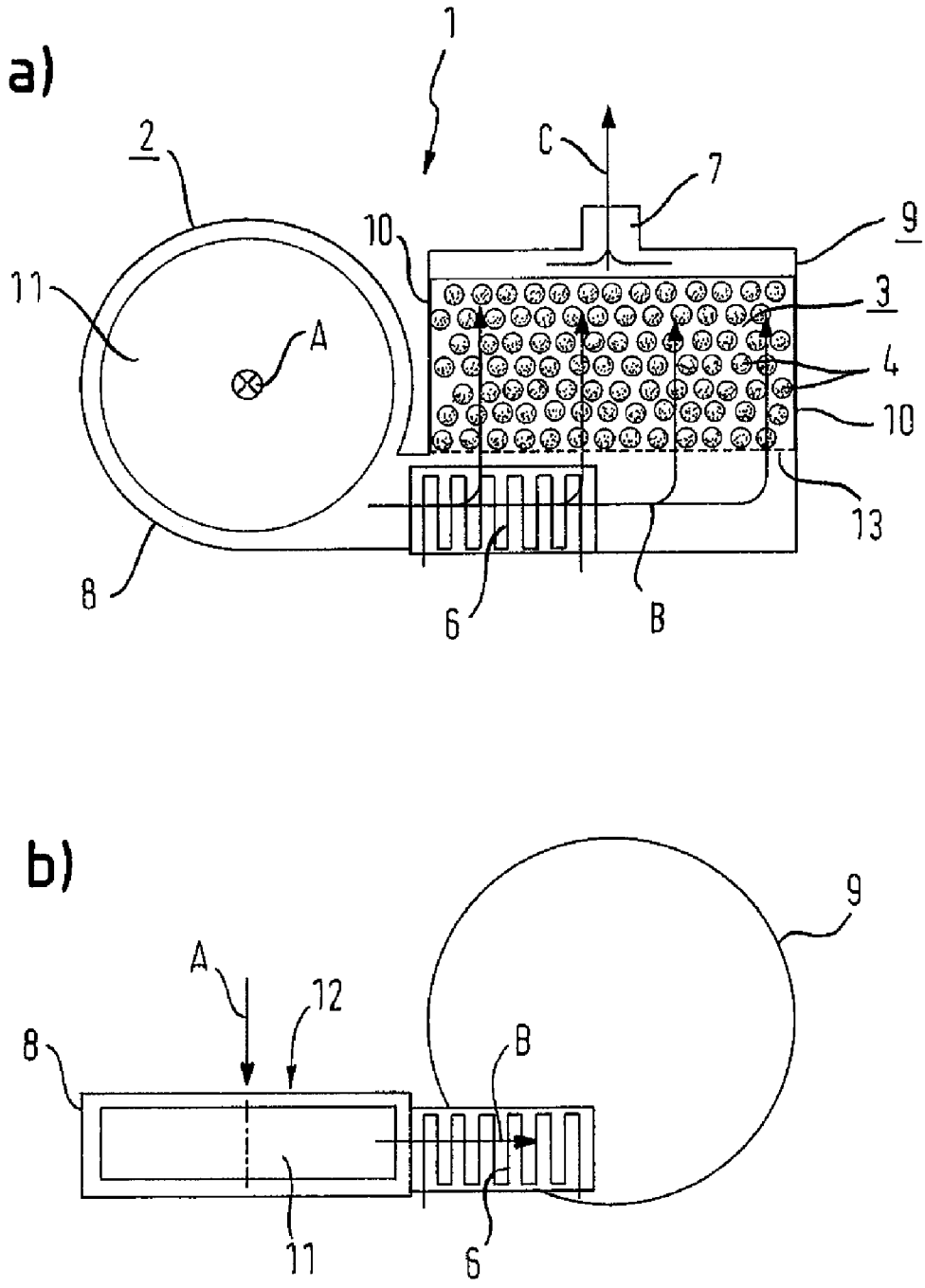
FIGS. 1*a, b* show a first exemplary embodiment of a sorption drying device that can be used in a dishwashing machine according to the invention, FIGS. 2*a, b* show a second exemplary embodiment of a sorption drying device that can be used in a dishwashing machine according to the invention, FIGS. 3*a, b* show a third exemplary embodiment of a sorption drying device that can be used in a dishwashing machine according to the invention.

FIG. 1 shows a first exemplary embodiment, which represents sorption drying device 1 in a sectional lateral view (FIG. 1*a*) and in a view from below (FIG. 1*b*). Sorption drying device 1 has a radial fan 2 with a propeller 11 in a fan housing 8, via whose inlet 12 air is sucked in, compressed and supplied to sorption column 3 by means of a heating device 6 designed as a wire heating device. Sorption column 3 is formed in a housing 9 which is cylindrical in shape. As shown in FIG. 1, the interior of the housing 9 is filled with a solid sorption column 3 of reversibly dehydratable material 4. The reversibly dehydratable material 4 is devoid of other materials across the diameter of the sorption column 3 and has a single wall encapsulating the sorption column 3 of reversibly dehydratable material 4. A wall 10, also referred to as a housing jacket, is provided with insulation which may be designed, for example, in the form of thermal insulation or a double wall, with or without a vacuum.

The base surface facing heating device 6 forms an inlet 13 of sorption column 3, which is preferably designed as a screen for fixing material 4 of reversibly dehydratable material 4 of sorption column 3 arranged in housing 9. Whilst air inlet 13 extends throughout the base surface in the exemplary embodiment, an air outlet 7 of the sorption column, arranged in the centre of the base surface, only occupies a small section of the surface, for example. Because of the size of air outlet 7 the flow resistance of the air conducted through sorption column 3 and its rate of escape from the washing compartment are unilaterally established. The air path is denoted by arrows A, B and C.

Heating device 6, designed as a wire heating device, is arranged at least in part outside the air inlet of the sorption column so that it overlaps air inlet 13. Contrary to the representation in the drawing, the wire heating device could also be formed underneath air inlet 13 so that it is completely overlapped. The size of the wire heating device and the proportion of the air inlet it overlaps depend substantially on the power discharged by the wire heating device. Because of the heating device 6 arranged outside, but in the immediate vicinity of air inlet 13, this produces the effect that the air conducted beyond the heating device as far as the inlet to sorption column 3 cannot cool or at least cannot cool substantially, so that effective heat supply and desorption of the reversibly dehydratable material are guaranteed. On the other hand, if the power output of the heating device is too high, if necessary, no local overheating of the reversibly dehydratable material will occur either.

In addition to the geometric dimensions of housing 9 of sorption column 3, the flow resistance of the air conducted through it is determined by the diameter of the spherical reversibly dehydratable material 4. When establishing the diameter of the reversibly dehydratable material a balance must be found between the desired surface area of this material and the flow resistance resulting directly from it. Reversibly dehydratable material of spherical design, with a diameter of 2.5 to 5 mm, has proved advantageous.

Figure 2:
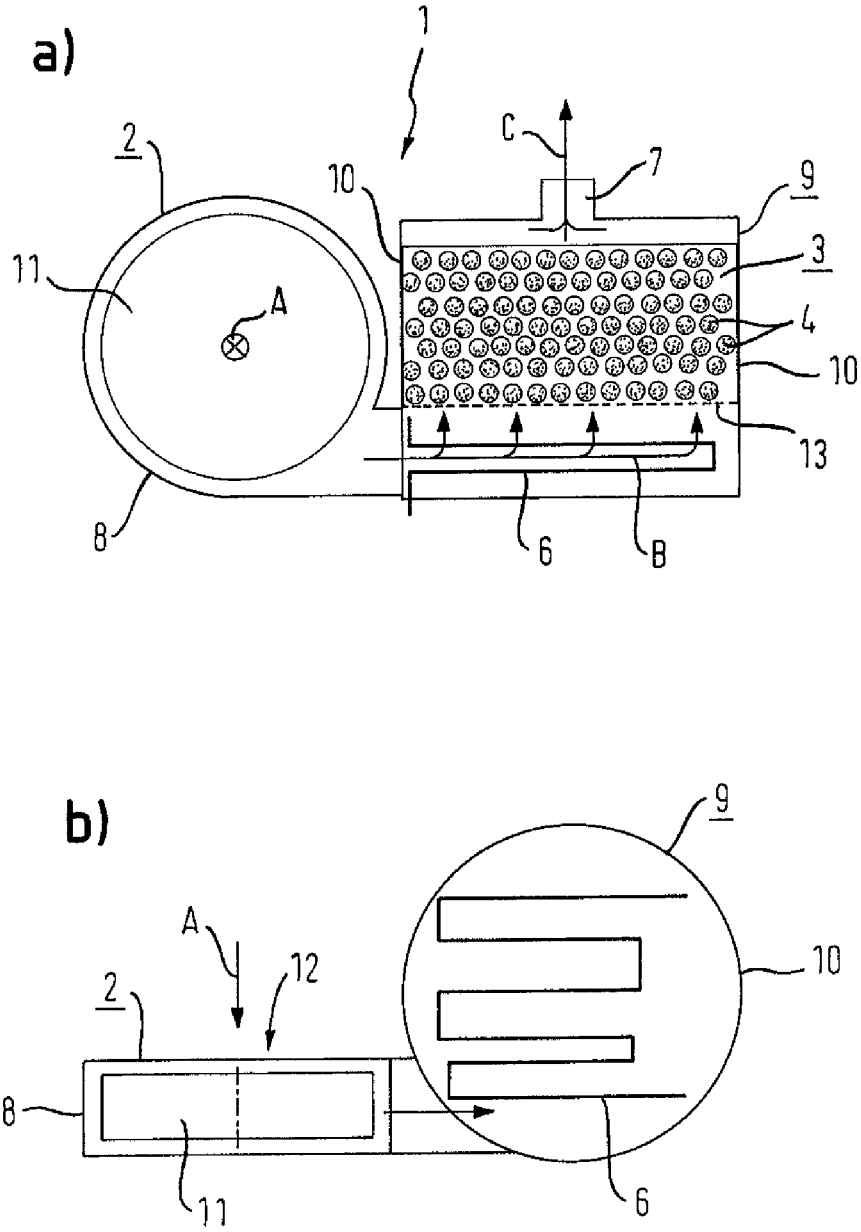

FIG. 2 shows a second exemplary embodiment of a sorption drying device 1 for use in a dishwashing machine according to the invention. FIG. 2*a* shows a sectional side view, FIG. 2*b* a view from below. The relative arrangement of fan housing 8, heating device 6 and housing 9 of the sorption column here corresponds to the exemplary embodiment described in connection with FIG. 1. In contrast to the preceding example, the heating device is designed predominantly as a tubular heating element (e.g. in the form of a wire or band heating device), which now extends throughout the area of air inlet 13. The disadvantage of this tubular heating element is the need for a very high heating power and a very high fan speed. If the sorption drying device is to be used simultaneously to heat washing solution inside the washing compartment, by introducing hot air or hot water vapour into the washing compartment, this type of heating may not be suitable for reasons of time.

Figure 3:
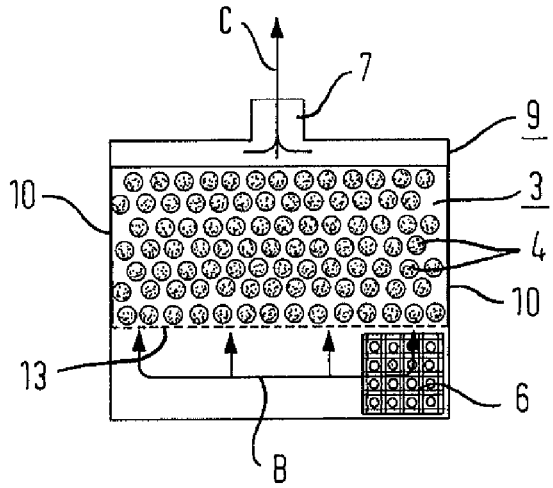
Figure 3:
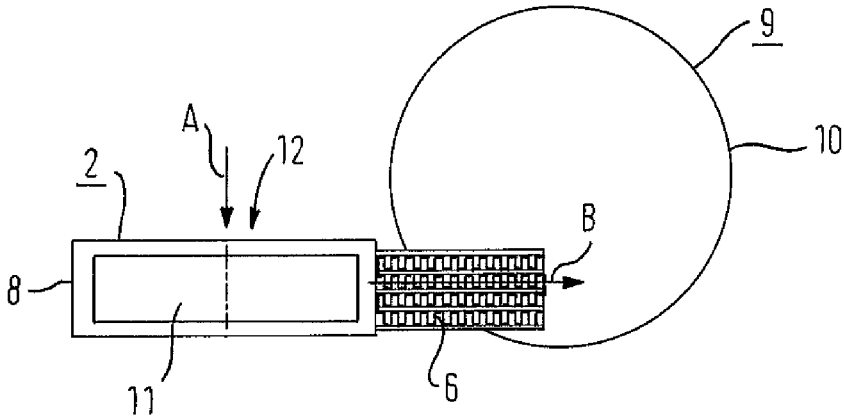

FIG. 3 shows a third exemplary embodiment whose structure also corresponds to the example described in connection with FIG. 1. FIG. 3*a* shows a sectional side view, FIG. 3*b* a view from below. In contrast to this the heating device is now designed as a ceramic heating device (a so-called honeycomb heater), which is more robust that a wire heater. One disadvantage of such a heating type, however, is the greater pressure loss as the air flows through heating device 6, which means that fan 2 must be operated at a higher speed.

Figure 4:
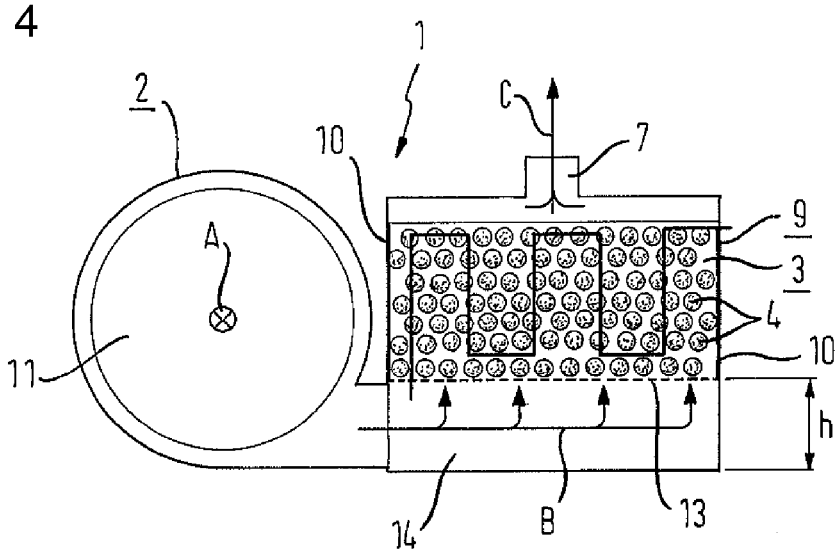
FIG. 4 shows a fourth exemplary embodiment of a sorption drying device that can be used in a dishwashing machine.
Figure 5:
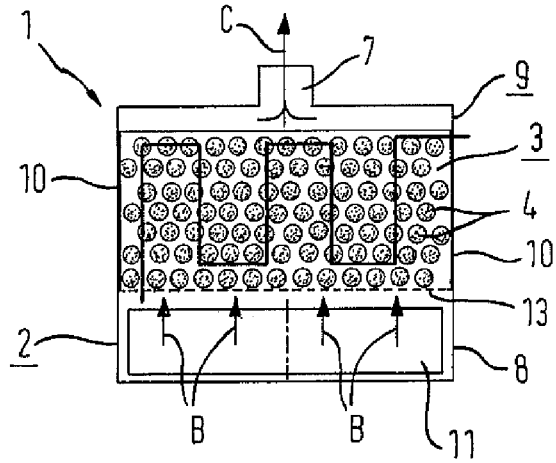
FIG. 5 shows a fifth exemplary embodiment of a sorption drying device that can be used in a dishwashing machine.

FIGS. 4 and 5 show further exemplary embodiments in which the heating device is formed inside sorption column 3. To avoid a very high power density the heating device preferably extends over a long length throughout the interior of sorption column 3. The advantage of such a design variant is that fan 2 can be designed both as a radial fan (FIG. 4) and an axial fan (FIG. 5). In this case it is possible, particularly in the variant shown in FIG. 4, to design the air duct designated by reference number 14 with a very low height h, providing a more compact arrangement. The variant shown in FIG. 5 may of course also be achieved with the heating types mentioned in the preceding exemplary embodiments, where a larger overall volume may have to be accepted.

Figure 6:
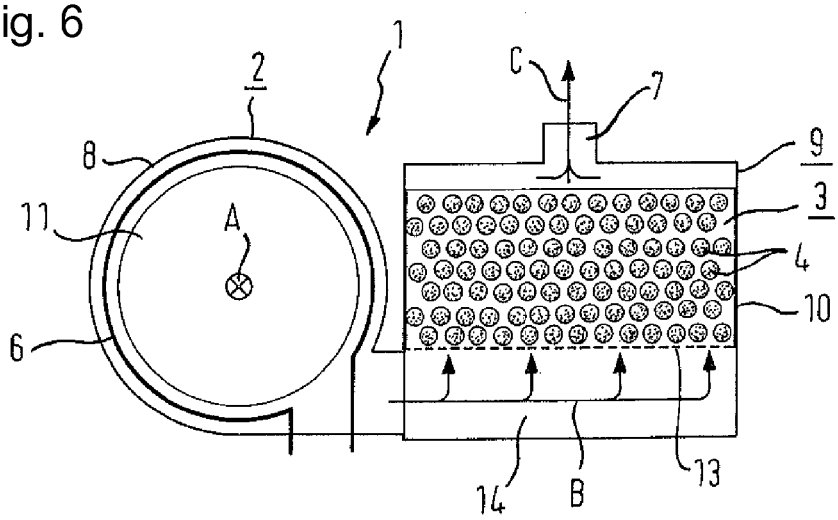
FIG. 6 shows a sixth exemplary embodiment of a sorption drying device that can be used in a dishwashing machine.

In the sixth exemplary embodiment shown in FIG. 6 a positive temperature coefficient (PTC) heater is represented as the heating device, arranged in the interior of fan housing 8 of fan 2. The PTC coat may be applied, for example, by a printing process to the inside of fan housing 8. The advantage of a PTC heater is that the heating power is controlled by the temperature prevailing in the PTC coat alone. Correspondingly air duct 14 can be designed to be very small, which also provides a compact sorption drying device.

In all the variants described above it is possible, to particular advantage, to design fan 2, heater 6 and sorption column 3 so that they form one integral unit, and, in particular, to constructed their housings integrally. Consequently, very simple assembly of the sorption drying device in the dishwashing machine is possible on the one hand, and the structural dimensions can be kept small on the other.

This invention provides a dishwashing machine with which it is possible, from the economic point of view, to clean and dry the items to be washed efficiently and to minimise the associated energy expenditure. Simple assembly, which allows a low cost production process, is also guaranteed.

What is claimed is:

1. A dishwasher comprising:

a washing container;

a device for washing crockery using a washing solution;

a sorption drying device in communication with the washing container such that air passes between the washing container and the sorption drying device, wherein the sorption drying device comprises:

a sorption column housing including:

a housing wall;

a base surface at an upstream end of the housing wall, the base surface having an air inlet for passage of the air from the washing container into the sorption drying device;

a cover surface at a downstream end of the housing wall, the cover surface having an air outlet for passage of the air from the sorption drying device to the washing container; and a column of reversibly dehydratable material disposed within the housing wall, the base surface, and the cover surface, the column having a shape defined by the housing wall, the base surface, and the cover surface, the housing wall, the base surface, and the cover surface of the sorption column housing being arranged to guide the passage of the air along a flow path extending in a direction of a height of the housing wall from the air inlet through the column of reversibly dehydratable material and out of the air outlet, the column of reversibly dehydratable material withdrawing moisture from the air during the passage of the air through the sorption drying device, wherein the height of the housing wall is less than a width of the base surface to reduce a flow resistance along the flow path through the column of reversibly dehydratable material;

a heating device disposed upstream of the air inlet such that the heating device heats the air prior to entering the air inlet and such that the column of reversibly dehydratable material is uniformly heated by the passage of the air along the flow path extending in the direction of the height of the housing wall from the air inlet, through the column of reversibly dehydratable material, and out of the air outlet; and a fan housing integrally formed with the sorption column housing, the fan housing having a fan disposed upstream of the air inlet of the housing of the sorption drying device and generating an air flow of the air through the sorption drying device, wherein the fan housing, the heating device, and the sorption column housing of the sorption drying device integrally form a single unit, wherein the air inlet extends entirely across the width of the base surface, and wherein the air outlet is arranged in a center of the cover surface and extends across only a portion of the cover surface.

2. The dishwasher of claim 1, wherein the height of the housing wall is less than a width of the cover surface.

3. The dishwasher of claim 1, wherein the housing wall is a single cylinder wall, wherein the base surface covers the upstream end of the single cylinder wall and the cover surface covers the downstream end of the single cylinder wall.

4. The dishwasher of claim 3, wherein the column of reversibly dehydratable material is a cylindrical column of reversibly dehydratable material having a shape defined by the single cylinder wall, the base surface, and the cover surface.

5. The dishwasher of claim 4, wherein the air inlet extends entirely across a diameter of the base surface.

6. The dishwasher of claim 5, wherein the height of the single cylinder wall is less than a diameter of the cover surface.

7. The dishwasher of claim 1, wherein one of the base surface and the cover surface comprises a screen surface.

8. The dishwasher of claim 1, wherein the heating device is arranged in a region of the air inlet of the sorption drying device.

9. The dishwasher of claim 1, wherein the heating device partially overlaps the air inlet.

10. The dishwasher of claim 1, wherein the heating device extends across the air inlet.

11. The dishwasher of claim 1, wherein the heating device extends across the width of the base surface.

12. The dishwasher of claim 1, wherein the heating device is disposed immediately adjacent an upstream side of the air inlet of the sorption drying device.

13. The dishwasher of claim 1, wherein the heating device is disposed immediately adjacent an upstream side of the air inlet of the sorption drying device and in an interior of the housing of the sorption drying device.

14. The dishwasher of claim 1, wherein the housing includes a thermally insulated housing jacket.

15. The dishwasher of claim 1, wherein the fan comprises an axial fan.

16. The dishwasher of claim 1, wherein the fan comprises a radial fan.

17. The dishwasher of claim 1, wherein the heating device is one of a wire heater, a tube-type heating element, a ceramic heater, and a heater having positive temperature coefficient (PTC) technology.

18. The dishwasher of claim 1, wherein the heating device is integrated in the fan housing.

19. The dishwasher of claim 1, wherein the reversibly dehydratable material includes spherical reversibly dehydratable material.

20. The dishwasher of claim 1, wherein the heating device is disposed downstream of the air inlet and within the column of reversibly dehydratable material such that the heating device uniformly heats the column of reversibly dehydratable material.

21. The dishwasher of claim 1, wherein, on the one hand the sorption drying device is used to dry crockery being handled by the dishwasher and, on the other hand, thermal energy utilized for desorption of the sorption drying device is used to at least partially heat at least one of the washing solution in the washing compartment and the crockery.

22. A dishwasher comprising:

a washing container;

a device for washing crockery using a washing solution;

sorption drying means in communication with the washing container such that air passes between the washing container and the sorption drying means, the sorption drying means for withdrawing moisture from the air during passage of the air through the sorption drying means; wherein the sorption drying means comprises:

a sorption column housing including:

a housing wall;

a base surface at an upstream end of the housing wall, the base surface having an air inlet for passage of the air from the washing container into the sorption drying means;

a cover surface at a downstream end of the housing wall, the cover surface having an air outlet for passage of the air from the sorption drying means to the washing container; and a column of reversibly dehydratable material disposed within the housing wall, the base surface, and the cover surface, the column having a shape defined by the housing wall, the base surface, and the cover surface, the housing wall, the base surface, and the cover surface of the sorption column housing being arranged to guide the passage of the air along a flow path extending in a direction of a height of the housing wall from the air inlet through the column of reversibly dehydratable material and out of the air outlet, the column of reversibly dehydratable material withdrawing moisture from the air during the passage of the air through the sorption drying means, wherein the height of the housing wall is less than a width of the base surface to reduce a flow resistance along the flow path through the column of reversibly dehydratable material;

guide means cooperating with the sorption drying means, the guide means for guiding the air through the sorption drying means and reducing a flow resistance along the flow path through the sorption drying means; and heating means for uniformly heating the sorption drying means, wherein the heating means includes a heating device disposed upstream of the air inlet such that the heating device heats the air prior to entering the air inlet and such that the column of reversibly dehydratable material is uniformly heated by the passage of the air along the flow path extending in the direction of the height of the housing wall from the air inlet, through the column of reversibly dehydratable material, and out of the air outlet;

wherein the guide means includes a fan housing integrally formed with the sorption column housing, the fan housing having a fan disposed upstream of the air inlet of the housing of the sorption drying means and generating an air flow of the air through the sorption drying means, wherein the fan housing, the heating device, and the sorption column housing of the sorption drying means integrally form a single unit, wherein the air inlet extends entirely across the width of the base surface, and wherein the air outlet is arranged in a center of the cover surface and extends across only a portion of the cover surface.

* * * * *